US005186401A

United States Patent [19]

Herdman et al.

[11] Patent Number: 5,186,401

[45] Date of Patent: Feb. 16, 1993

[54] CRUSHING MACHINE

[76] Inventors: James Herdman, 525 Main St., Chatham, N.J. 07928; John R. Paddock, Jr., 459 Washington Ave., Rutherford, N.J. 07070

[21] Appl. No.: 668,204

[22] Filed: Mar. 12, 1991

[51] Int. Cl.[5] ..... B02C 23/36

[52] U.S. Cl. ..... 241/46.01; 241/46.017; 241/285.2

[58] Field of Search ..... 241/46 R, 46 B, 46.04, 241/46.08, 285 R, 285 A, 46.06; 210/173, 174

[56] References Cited

U.S. PATENT DOCUMENTS

| | | | |
|---|---|---|---|
| 2,305,109 | 12/1942 | Santucci | 210/174 |
| 2,342,927 | 2/1944 | Durdin, Jr. | 210/174 |
| 2,591,388 | 4/1952 | Trotter | 241/46.08 |
| 3,247,970 | 4/1966 | Jellesma | 210/174 |
| 3,556,421 | 1/1971 | Galanty | 241/86 |
| 3,652,022 | 3/1972 | Miner et al. | 241/185 |
| 3,976,252 | 8/1976 | Perdue | 241/46.02 |

FOREIGN PATENT DOCUMENTS

| | | | |
|---|---|---|---|
| 8901364 | 2/1989 | United Kingdom | 241/DIG. 31 |

OTHER PUBLICATIONS

"Chicago Comminutor Engineering Bulletin", Dec. 1990.

*Primary Examiner*—Mark Rosenbaum
*Assistant Examiner*—John M. Husar
*Attorney, Agent, or Firm*—Mitchell P. Novick

[57] ABSTRACT

A crushing machine for insertion into a pipeline comprising a generally "T" pipe section containing a crushing cartridge - a plurality of crushing blades rotating within openings of a stationary bar/grid placed perpendicular to the flow in the pipeline. The crushing cartridge is completely removable as an single integral unit for quick and easy repair and reinstallation. A spare cartridge, fully adjusted and ready to use, may be installed while the removed cartridge is being serviced. The "T" pipe section may also be capped when the crushing mechanism is removed so that the pipeline flow may continue.

12 Claims, 6 Drawing Sheets

CRUSHING MACHINE

BACKGROUND OF THE INVENTION

1. Field of the Invention

This invention relates to a size-reduction apparatus installed in a pipeline, and more particularly to a piece of equipment designed to reduce materials transported in a pipeline to a consistent mixture prior to further processing.

2. Description of the Prior Art

The manufacture of a wide variety of materials requires the use of some type of size-reduction equipment in order to make their subsequent transport and reaction processes more efficient and cost-effective. It is therefore required that equipment be available to control the particle size, minimize the down-time when maintaining or replacing the unit and to maximize the flow characteristics.

There are a number of manufacturers currently producing size-reduction equipment, although few have a design suitable for installation in a pipeline. Nearly all these pipeline-installable machines use a similar principle to reduce the materials as they pass through. Cutter blades rotating around a common shaft pass through slots in a stationary bar or between rotating blades moving at a speed different than the cutter blades. The resulting particle size is equal to or less than the distance between the stationary or slow moving blades Presently, size-reduction equipment used to transport materials in a pipeline from one location to another has several process and cost-related inadequacies.

Firstly, for many of the prior art machines, in order to perform repair, maintenance, and replacement work, the entire unit must be removed from the pipeline. Such a machine is disclosed in U.S. Pat. No. 3,556.421 ("Chopping Machine"). This necessitates that the process flow be shut down for a significant period of time while the corrective maintenance is underway. The shutdown may be avoided if a bypass is incorporated in the design. The bypass permits an alternate path for the flow while the size-reduction unit is being serviced. However, the bypass greatly complicates the piping design and the bypass's size physically limits those locations where the size-reduction unit may be placed in the pipeline.

Another disadvantage of the design of many size-reduction machines is caused by the cutting/crushing unit's interruption of the flow in the pipeline. At the cutting/crushing unit, the pipeline's effective cross-sectional area is decreased causing a significant decrease in the flow, and a decrease in the amount of material that is processed. Correspondingly, the amount of energy required to process the material through the cutting/crushing unit is increased, the process time is longer, and additional wear and tear on the size-reduction unit results.

Lastly, another disadvantage of currently available size-reduction equipment is the difficulty and costly maintenance operations due to the relative inaccessibility of the working components, such as seals, bearings, and cutters. In addition, many units employ welded components which when damaged, cause progressive damage to all parts connected.

Prior art does disclose a size-reduction machine in which the cutting/crushing unit is removable from the pipeline without interrupting the pipeline's integrity. This machine is disclosed in U.S. Pat. No. 3,976,252

("Chopping Machine"). However, this machine's stationary blade set-up is quite complex. The stationary blades are a series of blades mounted around a rotating shaft, alternating with the individual cutting/crushing blades. The stationary blades are prevented from rotating by a pair of retaining lugs precisely positioned along the inside of the machine's housing. Servicing this cutting/crushing unit requires removing the cutting/crushing unit, removing the individual blades (both stationary and cutting/crushing) from the rotating shaft, and reinstalling all the blades back on the rotating shaft. This procedure is difficult and time-consuming: the cutting/crushing unit is not designed for removal from and installation in the pipeline as a single, integral unit. Accordingly, final adjustments must be done during actual installation of the cutting/crushing unit in the pipeline. Consequently, spare cutting/crushing units cannot be serviced and adjusted at a central maintenance site and stored in inventory for immediate installation when needed.

Furthermore, as disclosed in this patent, the bearings and packing between the stationary blades and the rotating shaft tends to wear away during operation and contaminate the flow. Such contamination may be unacceptable. Also, over time, this wearing away will cause the blades to loosen relative to each other, resulting in catastrophic damage to the unit: the blades eventually intermeshing and damaging the cutting/crushing unit beyond repair.

In short, the prior art devices are generally cumbersome to install, complicated to service, detrimental to pipeline flow, or require significant amounts of pipeline downtime during servicing.

SUMMARY OF THE INVENTION

A primary object of the present invention is a crushing machine that is easily serviced.

Another object of this invention is a crushing machine that eliminates the need for a bypass in the pipeline.

Still another object of this invention is a crushing machine that minimizes contamination of the pipeline flow.

Still another object of this invention is a crushing machine that minimizes the interruption of pipeline flow.

A final object of this invention is a single, integral crushing unit for a crushing machine.

Briefly, this invention is a crushing machine comprising a housing permanently installed in a pipeline. Inside the housing is a crushing cartridge comprising a stationary bar grid and a rotatable shaft attached to crushing blades. The crushing cartridge is removable and installable as a single unit. This invention provides easy access to repair and replacement of seals, bearings, crushing blades, and the stationary grid by the ability to remove the whole crushing cartridge from the housing by simply removing a few bolts. The cartridge is economical enough to keep one or more entire spare crushing cartridges in inventory. Thus, servicing may consist of replacing the crushing cartridge with a spare cartridge, and subsequently repairing the removed cartridge.

The present invention is designed so that the entire crushing cartridge is assembled and adjusted outside the body or housing of the crushing machine. Thus, the crushing cartridge can be removed as a single unit and replaced simply and easily in a single operation, while the body of the machine can remain in the pipeline.

The present invention is also designed to minimize process down-time. When the crushing cartridge is removed for repairs the opening in the housing through which the cartridge is removed may be covered by a blind flange (a commercially available pipe cap), allowing the continued use of the pipeline. Alternatively, a spare cutting cartridge may be easily installed in the pipeline pending repair of the original cutting cartridge.

This invention improves upon and provides a greater cross-sectional area for the size-reduction cartridge to operate in, thus increasing the flow characteristics and decreasing energy costs.

BRIEF DESCRIPTION OF DRAWINGS

1

DESCRIPTION OF PREFERRED EMBODIMENT

Figure 3:
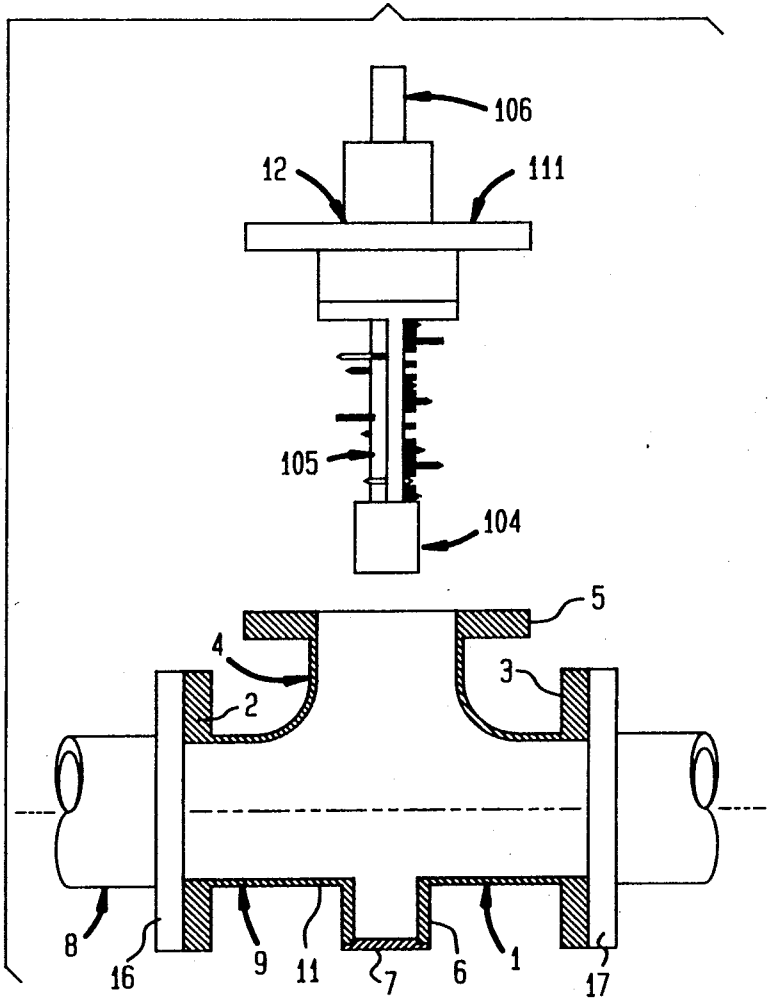
FIG. 3 is the cross-section of crushing machine as shown in FIG. 2 with the crushing cartridge removed and separate.
Figure 1:
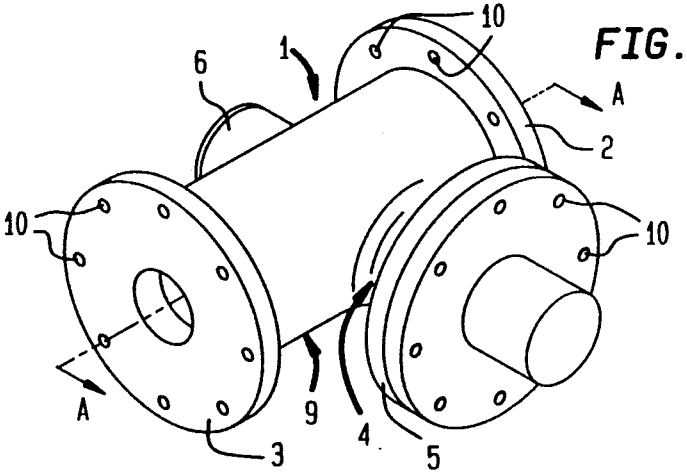
FIG. 1 is a perspective view of the crushing machine.
Figure 2:
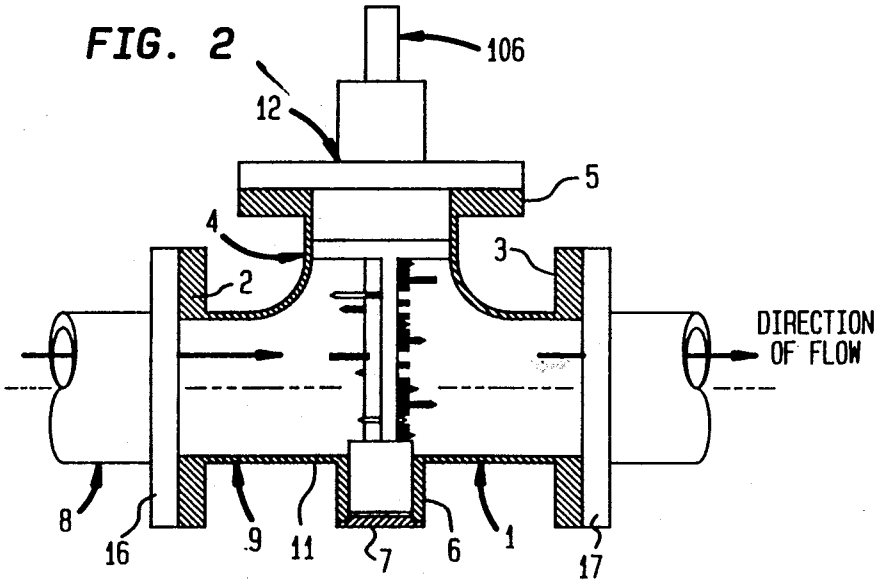
FIG. 2 is a cross-section of the crushing machine along Section A—A of FIG. 1.
Figure 4:
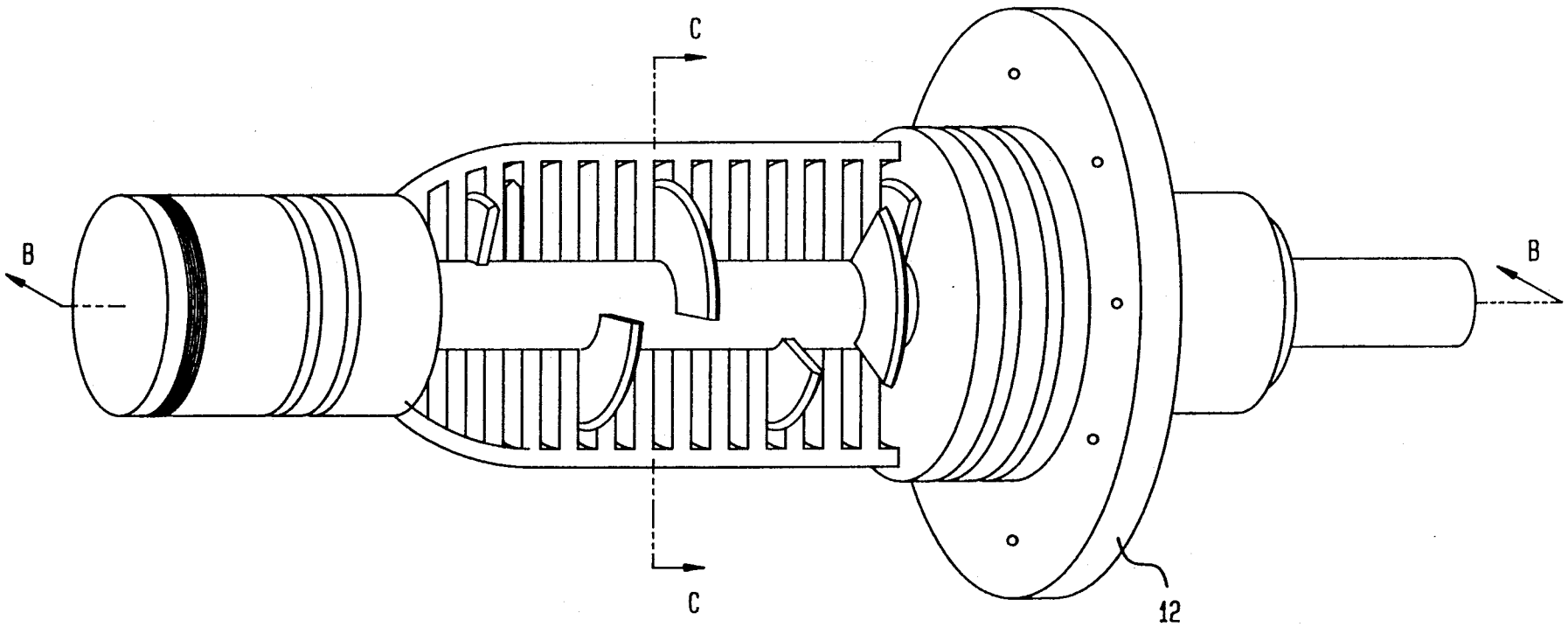
FIG. 4 is a perspective view of the crushing cartridge.
Figure 5:
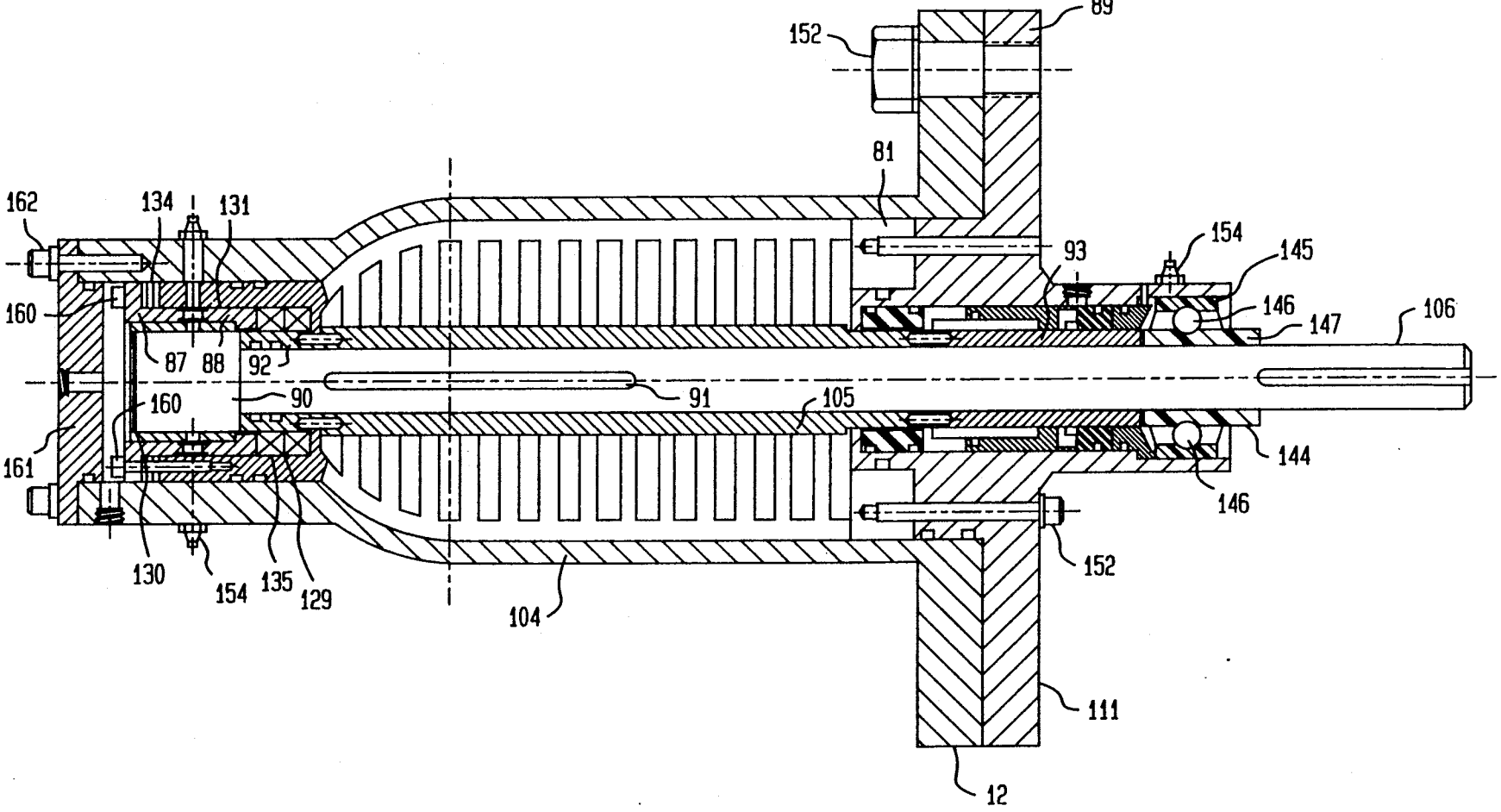
FIG. 5 is a cross-section of the crushing cartridge version utilizing a mechanical seal along Section B—B of FIG. 4.
Figure 6:
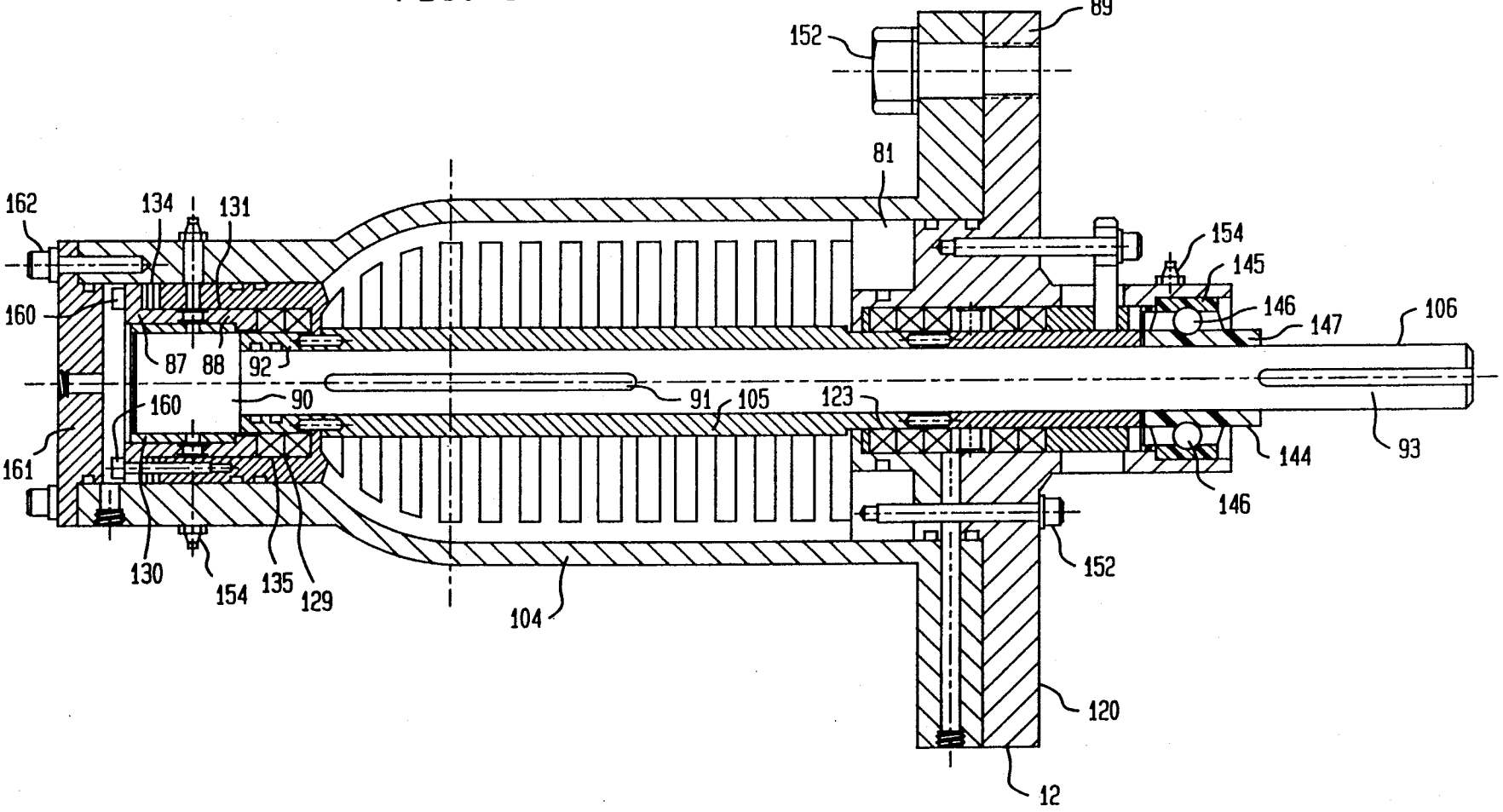
FIG. 6 is a cross-section of the crushing cartridge version utilizing packings along Section B—B of FIG. 4.
Figure 10:
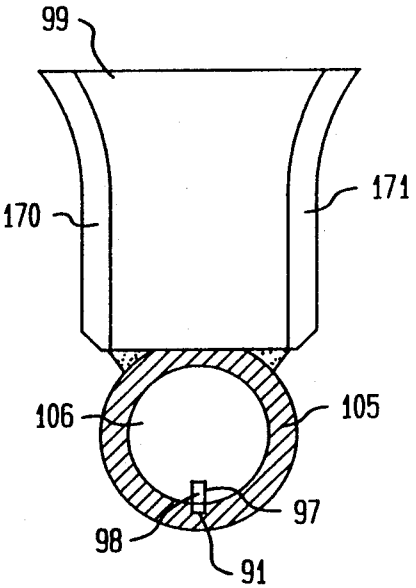
FIG. 10 is a cross-section of the shaft showing one attached blade along Section C—C of FIG. 4.
Figure 8:
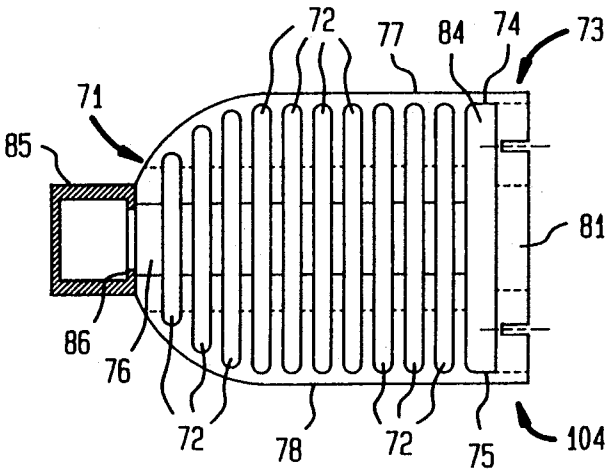
FIG. 8 is a cross-section view of the stationary bar/-grid assembly along Section B—B of FIG. 4.
Figure 7:
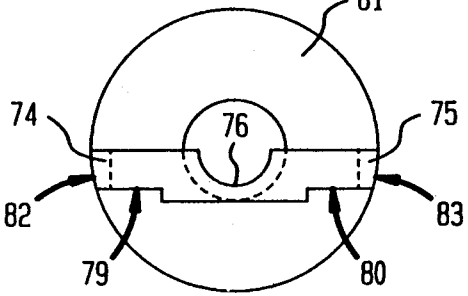
FIG. 7 is a cross-section of the crushing cartridge without the crushing blades along Section C—C of FIG. 4.
Figure 9:
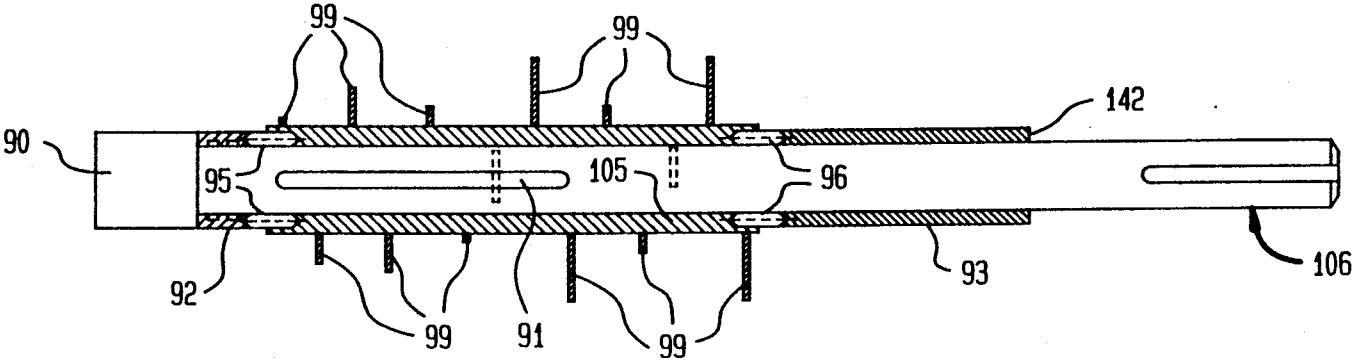
FIG. 9 is a cross-section of the shaft along Section B—B of FIG. 4.
Figure 12:
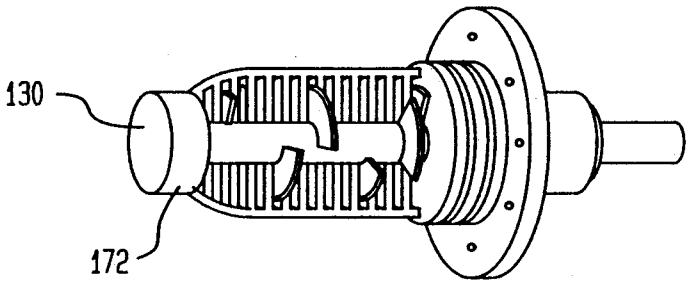
FIG. 12 is a perspective view of the crushing machine cartridge used with the housing shown in FIG. 11.
Figure 14:
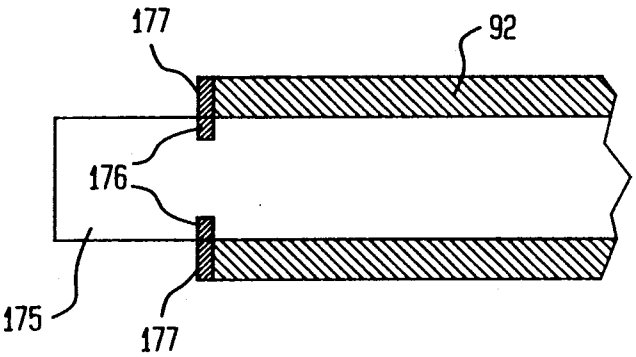
FIG. 14 is a cross-section of the cap end section of the crushing cartridge shaft for a uniform diameter shaft.
Figure 11:
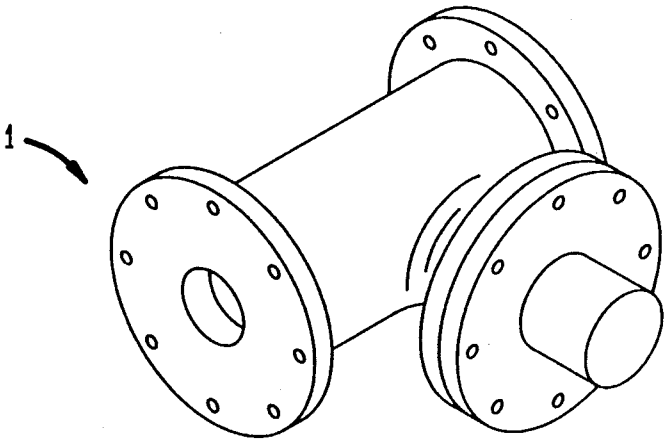
FIG. 11 is a perspective view of the standard "T" housing for the crushing machine version using this housing.

The preferred embodiment of this invention is designed for cylindrical pipeline installation and operates as an in-line crushing device that uses a series of rotating blades which intermesh at close tolerance with a corresponding set of stationary bars. Materials crushed are slurries (a mix of solids and liquids) or pneumatically conveyed dry materials and other types of feed systems, such as screw conveyors that can or do use a pipe as part of its conveying system. A stationary bar grid placed perpendicular to the flow traps particles that are larger than the spacing between the bars in front of the grid, while the smaller particles pass through freely. A series of rotating crushing blades intermesh with the stationary bar grid with sufficient speed and power to crush the trapped particles, thereby reducing their size, and push them through the bar grid slots while clearing the bar/grid slots at the same time.

The preferred embodiment comprises a crushing machine with a housing 1. The housing 1, as all other metallic parts of this invention, is of stainless steel or other steel alloys commonly used in the materials process industry. The housing 1 is generally "T" shaped: cylindrical flow pipe 9 with an inside diameter equal to that of the process piping 8 and a cylindrical pipe 4 extending perpendicular to the axis of the cylindrical pipe 9 and midway between flanges 2 and 3. The open ends of pipes 9 and 4 terminate in flanges 2, 3, and 5 respectively. The housing 1 is connected in-line by flanges 2 and 3 to flanges 6, 7 on the process piping 8 with a plurality of bolts passing through corresponding holes 10; preferably, there are eight bolts for each flange. Flange 5 is bolted on one end to a removable cartridge 12 at seal/bearing housing 111 providing support for shaft 106.

The housing 1 provides some of the advantages of this invention. First, the installation of the crushing machine is virtually identical to installing a standard "T" pipe fitting; users of the machine would almost certainly have had previous experience handling "T" pipe fittings in pipelines. Second, in the design of a typical pipeline, enough room is allowed for installing standard "T" pipe fittings, thus, without redesigning the pipeline, there is enough room to install the crushing machine.

Along the same vertical axis as pipe 4 and intersecting pipe 9 at the outer wall 11, there is a bore through the outer wall of pipe 9 to which a cylindrical pipe 6 is attached by welding or casting, terminating in a cap-end flange 7. The opening at the terminal end of pipe 6 is covered by a cap-end plate 161, secured to the pipe 6 by assembly bolts 162.

The housing 1 removably contains a removable crushing cartridge 12. The cartridge 12 comprises a bar/grid assembly 104, a shaft 106 contained within the bar/grid assembly 104, and sealing means 111, 129 at each end of the bar/grid assembly 104. The cartridge 12 is designed to be installed so that it is perpendicular to the axis of pipe 9 and so that the stationary bar/grid 104 is perpendicular to the flow in the process pipeline 8.

The stationary bar/grid assembly 104 is designed to be inserted in housing 1 through pipe 4 and pipe 9 and terminates in pipe 6 at take-up spacers 134. The stationary bar/grid assembly 104 is fabricated or cast from a solid bar having a generally rectangular cross-section. Using a single, solid piece of metal gives the bar/grid assembly 104 greater structural integrity. The assembly 104 is rounded at the two corners of one edge 71. Slots 72 are cut out along the width perpendicular to the vertical axis, leaving a constant edge distance or rim of material. The edge 73 opposite the rounded edge 71 has a rectangular section removed from the middle, leaving two side tabs 74, 75. On one face of the bar/grid assembly 104, a semi-circular groove 76 with its axis along the surface of that face is bored or cast to contain the shaft 106 and the rotor 105. The outer edges 71, 77, 78 of the bar/grid assembly 104 are curved to follow the inner curvature of the pipe housing 1. Thus, the edges 77, 78 are curved along a cylinder coaxial with the groove 76 and the rounded edge 71 is curved along a cylinder whose axis is normal with the groove 76. Preferably, to aid in manufacturing generally rectangular channels 79, 80 are made in the bar by removing material from the face of the bar/grid assembly 104 opposite the face with the groove 76, along the entire length of both edges 77, 78 in the bar/grid's 104 lengthwise direction.

A bar/grid ring 81 having slots 82, 83 cut out at the two opposite ends of one diameter, the slots 82, 83 matching the cross-section of the side tabs 74, 75, is positioned over the side tabs 74, 75 to produce a terminal slot 84 of equal width to the other bar/grid slots 72. The bar/grid ring 81 is welded to the side tabs 74, 75.

The shaft 106 is a solid cylinder with a thickened diameter at one end 90. The shaft 106 is long enough so that when the cartridge 12 is inserted into the housing 1, the shaft 106 extends out of the housing 1 and can connect to an external electric motor (not shown) via a belt drive (not shown). Along the length of the shaft 106 is a key slot 91 the thickness of which is dependent on its diameter.

Over the shaft 106 are two shaft sleeves 92, 93 with a rotor 105 in between them. The outer diameter of each shaft sleeve 92, 93 is preferably equal to the diameter of rotor 105. Each shaft sleeve 92, 93 is held in rotation with the rotor 105 through the use of two or more steel dowel pins 95, 96 at the edges where the sleeve and rotor meet. The diameter of the dowel pins is dependent on the thickness of the shaft sleeve 92, 93 walls. The rotor 105 has an internal key slot 97 which corresponds with the key slot 91 in the shaft 106. The rotor 105 is attached to the shaft 106 by a steel key 98 inserted through these key slots 91, 97. In this manner, the rotor 105 is forced to rotate with the shaft 106.

The sleeves 92, 93 serve as spacers between the shaft 106 and the sealing mechanisms 111, 129 and prevent wear on the shaft 106, which would otherwise be in direct contact with the seal mechanisms 111, 129 and the material flowing through the pipeline 8. Thus, the less expensive and easily replaced shaft sleeves 92, 93 absorb any damage from such contact rather than damaging the more expensive shaft 106.

The rotor 105, utilizes a sleeve whose thickness is chosen to be of sufficient strength to securely hold the crushing blades 99 after welding. The rotor 105 is positioned around the mid-section of the shaft 106. The rotor 105 comprises a shaft sleeve with crushing blades 99 welded to the outer surface of the sleeve perpendicular to the axis of the sleeve. The spacing between blades 99 matches the spacing of the slots 72 in the bar/grid assembly 104 so that one blade 99 corresponds to each such slot 72, 84. To balance the weight distribution of the blades 99 during rotation, the blades 99 are placed circumferentially around the shaft 106 so that the angles between each pair of consecutive blades are approximately equal. The preferred measurement of these angles is in the range of 140 and 180 degrees. At the preferred angles, only one blade enters the stationary bar/grid assembly 104 at any one time, thus effectively concentrating the torque of the motor.

The crushing blades 99 are generally rectangular in cross section, flared outward towards the unattached edge. Preferably, these blades 99 have two sharpened crushing edges 170, 171. Thus, the blades 99 will crush effectively whether the shaft 106 is rotated in a clockwise or counterclockwise direction.

To center the crushing blades 99 within the bar/grid slots 72, 84, metal ring spacers 142 are selectively inserted and removed around the shaft 106 between the unkeyed edge of shaft sleeve 93 and the inner ring bearing assembly 144. Individual spacers 142 have a preferable thickness of 0.005"–0.010"; preferably, spacer use should be limited so that the cumulative thickness of all spacers 142 does not exceed 0.035"±0.010".

Welded to the rounded edge 71 of the bar/grid assembly 104 is a cylindrical shaped grid hub 85. This grid hub 85 has an external diameter which approximates the internal diameter of the housing extension 6. The grid hub 85 has an internal bore whose a diameter approximates the outer diameter of the cap-end bearing assembly 131. The grid hub 85, at its welded end, has an internal flange 86 with an internal diameter slightly larger than the shaft's diameter at the shaft's thickened end 91.

Surrounding the grid hub 85 of the bar/grid assembly 104 is a cap-end bearing assembly 131. The cap-end bearing assembly 131 comprises a cylindrical pipe with an external flange 87 at one end and an internal flange 88 at the other end. The external flange 87 has openings to accommodate two or more bolts 160 for attachment to the grid hub 85 of the bar/grid assembly 104. The internal flange 88 has an internal diameter slightly larger than the shaft's diameter at the shaft's thickened end 91. The internal diameter of the cap-end bearing assembly 131 itself is slightly larger than the internal flange's 88 internal diameter. The cap-end bearing assembly 131 contains a cap-end bearing 130 preferably comprising a Teflon-type sleeve which fits snugly around the shaft's thickened end 91 when the shaft 106 is inserted into the cap-end bearing assembly 131. Teflon is a self-lubricating, highly chemically inert material ideal for flowline applications. To insure that the cap-end bearing 130 does not move or rotate within the bearing assembly 131, the internal diameter of the bearing assembly 131 is greater than the outer diameter of the cap-end bearing 130; the cap-end bearing 130 is press-fit into the bearing assembly 131; press fitting is well known in the prior art.

The cap-end bearing assembly 131 supports the rotating shaft 106. The cap-end is sealed by industry-standard packing 135 to keep grit out of the cap-end bearing 130. To increase the compression on the packing 135 in the cap-end bearing assembly 131, metal ring spacers 134 are selectively inserted and removed around the cap-end bearing assembly 131 between the cap-end outer flange 87 and the edge of the bar/grid grid hub 85. Using more spacers 134 decreases compression; using less spacers 134 increases compression. Individual spacers 134 have a preferable thickness of 1/16".

At the end of the bar/grid assembly 104 where the shaft 106 emerges from the housing 1 is a seal/bearing housing 111. The seal/bearing housing 111 comprises a cylindrical pipe with an external flange 89 at one end. A mechanical-type sealing mechanism 111 is used. This type of sealing mechanisms is well-known in the prior art. The preferable materials for the mechanical seals are tungsten carbide or silicon carbide. The preferable mechanical seal is the Chesterton 880, a commercially available product. To carry away built-up heat on the seal 111, water is pumped into at least one purge fitting 154 at a pressure higher than the pipeline pressure. Use of these mechanical seals is well-known in the prior art.

The sealing assembly 111 keeps pressure from dropping in the pipeline 8 and also keeps material flowing in the pipeline 8 from escaping.

The seal/bearing housing 111 also contains an extended inner ring bearing assembly 144. This item, well-known in the prior art, contains a series of ball bearings 146 between an outer shell 145 and an inner tube 147. The inner tube 147 is free to rotate within the shell 145, supported by the ball bearings 146. The inner diameter of the inner tube 147 approximates the outer diameter of the shaft 106. The shaft 106 is inserted into the inner tube 147 and secured there by a set screw. This ring bearing assembly 144 is supplied with at least one grease fitting 154. Use of these ring bearing assemblies is well-known in the prior art.

The seal/bearing housing 111 is secured to the crushing cartridge 12 with a plurality of assembly bolts 152 which are inserted through clearance holes in the flange 89 and into corresponding threaded holes in the bar/-grid ring 81. Preferably two or four bolts are used, located at opposite ends of a diameter of the bar/grid ring 81.

The mechanical-type sealing mechanism 111 is preferred when liquid is flowing through the pipeline 8. When dry materials are flowing through the pipeline 8, an alternative packing-type sealing mechanism 120 is preferred. Furthermore, the packing-type sealing mechanism may be used as a less expensive alternative to the mechanical seal 111. This type of sealing mechanism is well known in the prior art. The packing-type sealing mechanism 120 comprises a series of rings 123 of square rope stacked around the shaft sleeve 93. Preferably, this is Teflon rope. This rope is inert and "food grade"; thus, there is minimal danger of harmful contamination of the flow. The rings 123 are held in compression. Use of these packing-type mechanisms is well-known in the prior art. Like the mechanical seal 111, the packing mechanism 120 contains the inner ring bearing assembly 144 and is secured to the crushing cartridge 12 by the assembly bolts 152 inserted through the flange 89.

In use, the crushing machine housing 1 is installed in the pipeline 8 as any other section of pipe. The crushing cartridge 12 is installed in the housing 1, with the stationary bar/grid 104 perpendicular to the flow, and attached to the electric motor via the belt drive. The flow of material commences, and as the flow passes through the crushing machine, the crushing cartridge 12 reduces the size of those particles too large to fit between the slots 72, 84 of the stationary bar/grid 104 and pushes them through the bar/grid 104. At the same time, the crushing blades 99 attached to the rotor 105 constantly clean the stationary bar/grid 104. The flow then continues through the pipeline 8.

The output of the crushing machine can be controlled to an extent by the slot size of the stationary bar/grid 104, and is based on the size of the pipeline 8 in which it will be used. The machine is intended to reduce all the materials traveling through the pipeline 8 to a consistent free-flowing size.

Typically, the crushing machine is used in a one-pass flow operation. Nevertheless, the crushing machine can be used in a recirculating flow operation, where the flow passes through the crushing machine more than once.

Furthermore, the design of the crushing machine allows a larger cross-section at the crushing cartridge 12 for the flow to travel across than in prior art devices. This results less impeded flow, less energy used, and less waste heat produced in the pipeline 8. For example, this invention allows for approximately 30–40% more open flow area than the machine disclosed in U.S. Pat. No. 3,556,421.

To repair or service the cap-end bearing 130, the bolts 162 in the pipe extension 6 are removed and the cap-end plate 161 is removed. The operator can then remove and/or service the cap-end bearing 130. This procedure takes only a few minutes. In addition, this procedure may be used by the operator to get a general feel for the condition of the flow.

To repair or service the crushing cartridge 12, the motor and belt drives are removed, the bolts 152 in the seal/bearing housing 111 or 120 are removed, and the entire cartridge 12 is removed. The operator can then install a spare cartridge 12, reinsert the bolts 152, reconnect the motor, and the pipeline flow 8 can continue with an interruption of only a few minutes. The removed cartridge 12 may be serviced at an off-site machine shop at a more leisurely pace.

Alternatively, a blind flange may be placed over the opening in the housing 1 through which the cartridge 12 was removed and the pipeline flow 8 may continue during the time the removed cartridge 12 is being repaired, although the protection provided by an operating crushing cartridge 12 will be missing.

Another use of the removable cartridge 12 is for intermittent crushing needs. For examples, some processes only produce large particles in the flow during a cleaning procedure upline of the crushing machine location. Thus, the crushing cartridge 12 is installed and used only during such cleaning processes. During the remaining periods, the crushing cartridge 12 is removed and a blind flange is installed over the resulting opening in the housing 1. Thus, completely unimpeded flow results in the pipeline 8 for a majority of the time.

In an alternative embodiment, the housing 1 comprises a standard "T" pipe fitting. This standard "T" is commonly used in many piping systems and is widely available from pipe vendors. In this embodiment, the grid hub 172 has an internal diameter slightly larger than the shaft's diameter at the shaft's thickened end 91. The Teflon-type sleeve bearing 130 is press-fit inside the grid hub 172. There is no independent cap-end bearing assembly in this embodiment.

This embodiment has fewer parts and is less expensive to manufacture. However, the cap-end bearing 130 is exposed to, and resides directly in the flow. Also, this alternative embodiment does not allow access to the cap-end bearing 130 without removing the crushing cartridge 12.

Figure 13:
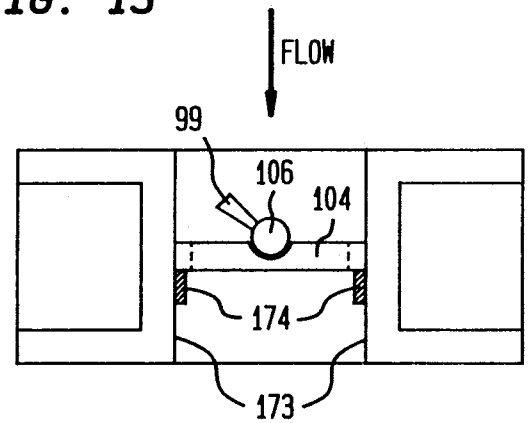
FIG. 13 is a cross-section of the crushing machine installed in a rectangular pipeline.

Another alternative embodiment comprises a crushing machine for use in a pipeline 8 with a square or rectangular cross section (see FIG. 13). Such pipelines may be fabricated from a sheet channel and may be easier to use in conveyor systems. In this type of pipeline 8, the crushing cartridge 12, during insertion and removal, is not naturally supported by the curved inner surface of the pipeline 8. Such support makes guiding the cartridge 12 easier during insertion and removal, and also helps prevent the cartridge 12 from swinging and crashing into the pipe wall 173, potentially damaging the cartridge 12 and the pipe 173. To provide this missing support, two rectangular support bars 174 are welded to inside of the pipe wall 173. The crushing cartridge 12 slides along these support bars 174 during installation and removal, and rests on them when installed.

Another embodiment of the crushing cartridge 12 comprises a shaft 175 of uniform dimension throughout. This uniform shaft 175 has slot 176 machined along its circumference beyond the extent of the cap-end bearing assemble 131 into which a retaining ring 177 is placed. The retaining ring 177 holds the cap-end shaft sleeve 92 in position. The cap-end bearing assembly 131 previously described has its internal diameter adjusted to be slightly larger than the shaft 175.

Although this invention has been described with a certain degree of particularity, it is to be understood that the present disclosure has been made only by way of illustration and that numerous changes in the details of the method may be resorted to without departing from the spirit and scope of this invention. For example, the number, shape or thickness of the blades may be altered. Additionally lip seals may replace the mechanical sealing mechanism 111 or the packing 120; lip seals are well-known in the prior art.

We claim:

1. A crushing machine comprising:

(a) a housing comprising a "T"-shaped hollow body having two conduit ends adapted for connection into a flow line and having a bore end;

(b) said hollow body defining a cartridge bore fully intersecting the flow path between said conduit ends and terminating in said bore end;

(c) a crushing cartridge independent of said cartridge bore, said crushing cartridge extending axially through said cartridge bore, through said bore end and adapted for rotation by an external power source, said crushing cartridge being removable from and installable into said housing as a single, integral unit, and said crushing cartridge further being serviceable and adjustable independently of said housing; and (d) attachment means to attach said crushing cartridge to said housing at said bore end.

2. A crushing machine as described in claim 1, in which said housing further comprises a cap bore, extending through said housing opposite said bore end co-axial with said cartridge bore and terminating in a cap bore end.

3. A crushing machine as described in claim 2, (a) said crushing cartridge having a cartridge cap end located near said cap bore end when said crushing cartridge is installed in said housing; and (b) in which said cap bore end further comprises means to remove and/or service said cartridge cap end and means to determine the condition of the flow in said flow line while said crushing cartridge is installed in said housing.

4. A crushing machine as described in claim 3, in which said cap bore end further comprises a cap end bearing assembly to support said cartridge cap end, said cap end bearing assembly being removable from and installable into said cap bore end while said crushing cartridge remains installed in said housing and while said housing remains in said flow line.

5. A crushing machine as described in claim 4, further comprising cartridge support means integrally attached to said housing.

6. A crushing machine comprising:

(a) a housing comprising a "T"-shaped hollow body having two conduit ends adapted for connection into a flow line and defining a bore fully intersecting the flow path between said conduit ends, said bore having a bore end and a cap end opposite said bore end;

(b) a crushing cartridge extending axially through said bore, through said bore end and terminating at said cap end, adapted for rotation by an external power source, said crushing cartridge being removable from and installable into said housing as a single, integral unit, and said crushing cartridge further being serviceable and adjustable independently of said housing, said crushing cartridge being adapted to effectively intersect said complete flow path, said crushing cartridge comprising:

(1) a unitary rigid grid having a plurality of parallel grid openings, said grid being of unitary construction, said grid having a shaft cap end and a shaft exit end;

(2) a groove in said grid running from said shaft cap end to said exit end;

(3) a shaft removably inserted in said groove;

(4) a rotor hub slidably fitting over said shaft;

(5) means to removably secure said rotor hub to said shaft, inducing said hub to mimic the angular movement of said shaft;

(6) a plurality of rotatable crushing blades fastened transversely to said rotor hub to rotate with said hub, each said blade being angularly displaced on said hub with respect to each adjacent rotatable blade, and each said blade corresponding to one of said grid openings and positioned along said rotor hub within its corresponding said grid opening;

(5) lateral adjustment means to adjust the location of each said cutter blade with its corresponding said opening.

(6) cap end bearing means at said shaft cap end to support said shaft;

(7) exit bearing means at said shaft exit end to support said shaft;

(8) cap sealing means adapted to prevent contamination of said cap end bearing means; and (9) exit sealing means adapted to prevent material from said flow line from exiting said flow line and maintain line pressure in said flow line;

(c) attachment means to attach said crushing cartridge to said housing at said shaft exit end.

(d) said cap end bearing means comprising a cap end bearing assembly being removable from and installable into said cap end while said crushing cartridge remains installed in said housing and said housing remains in said flow line; and in which said cap bore end further comprises means to remove and/or service said cartridge cap end and means to determine the condition of the flow in said flow line.

7. A crushing cartridge for use in an in-line crushing device comprising a housing, said crushing cartridge comprising:

(a) a unitary, rigid grid having a plurality of parallel openings, said grid being of unitary construction, said grid having a leading end and a trailing end;

(b) a groove in said grid running from said leading end to said trailing end;

(c) a shaft removable inserted in said groove, said shaft further comprising a plurality of rotatable crushing blades, with each said crushing blade corresponding to one of said openings and positioned along said shaft within its corresponding said opening;

(d) support means for supporting said shaft in said groove; and (e) attachment means at said leading end, said attachment means permitting attachment of said cartridge to said housing.

8. A crushing cartridge as described in claim 7, further comprising lateral adjustment means to adjust the location of each said cutter blade with its corresponding said opening.

9. A crushing cartridge as described in claim 8, in which said support means comprises:

(a) first bearing means at said leading end; and (b) second bearing means at said trailing end.

10. A crushing cartridge as described in claim 9, further comprising:

(a) first sealing means at said leading end; and (b) second sealing means at said trailing end.

11. A crushing cartridge as described in claim 10, in which said first sealing means comprises a mechanical seal.

12. A crushing cartridge as described in claim 10, in which said first sealing means comprises packing.

* * * * *